US008985153B2

(12) United States Patent
Didier et al.

(10) Patent No.: US 8,985,153 B2
(45) Date of Patent: Mar. 24, 2015

(54) VALVE SUB-BASE

(75) Inventors: Richardet Didier, Crassier (CH); Stefan Gairing, Geneva (CH)

(73) Assignee: Fluid Automation Systems S.A, Versoix (CH)

( * ) Notice: Subject to any disclaimer, the term of this patent is extended or adjusted under 35 U.S.C. 154(b) by 154 days.

(21) Appl. No.: 13/641,505

(22) PCT Filed: Apr. 28, 2011

(86) PCT No.: PCT/EP2011/056806

§ 371 (c)(1),
(2), (4) Date: Oct. 16, 2012

(87) PCT Pub. No.: WO2011/138235

PCT Pub. Date: Nov. 10, 2011

(65) Prior Publication Data

US 2013/0037128 A1 Feb. 14, 2013

Related U.S. Application Data

(60) Provisional application No. 61/330,985, filed on May 4, 2010.

(51) Int. Cl.
*F15B 13/08* (2006.01)

(52) U.S. Cl.
CPC ..... *F15B 13/0817* (2013.01); *F15B 13/0821* (2013.01); *F15B 13/0882* (2013.01)
USPC ..... 137/884; 137/271

(58) Field of Classification Search
CPC ..... F15B 13/0882; F15B 13/0828; F15B 13/0817; F15B 13/0821
USPC ..... 137/884, 271, 269
See application file for complete search history.

(56) References Cited

U.S. PATENT DOCUMENTS

| | | | | | |
|---|---|---|---|---|---|
| 3,457,943 | A | * | 7/1969 | Kawabata | 137/269 |
| 3,698,432 | A | * | 10/1972 | Kutz | 137/884 |
| 3,817,269 | A | * | 6/1974 | Raymond | 137/269 |
| 3,848,901 | A | * | 11/1974 | Hoffman | 285/124.4 |
| 3,888,518 | A | * | 6/1975 | Delessert | 285/39 |
| 3,934,605 | A | * | 1/1976 | Legris | 137/271 |
| 4,082,324 | A | * | 4/1978 | Obrecht | 285/124.5 |
| 4,224,957 | A | * | 9/1980 | Darves et al. | 137/270 |
| 4,247,133 | A | * | 1/1981 | Moller | 285/4 |
| 4,699,402 | A | * | 10/1987 | Stoll et al. | 285/26 |
| 5,178,191 | A | * | 1/1993 | Schaefer | 137/884 |
| 5,460,204 | A | * | 10/1995 | Rossi | 137/884 |
| 5,749,562 | A | * | 5/1998 | Moller et al. | 251/367 |

(Continued)

FOREIGN PATENT DOCUMENTS

| | | | |
|---|---|---|---|
| FR | 7340790 | A1 | 6/1975 |
| WO | 9857078 | A1 | 12/1998 |

*Primary Examiner* — John K Fristoe, Jr.
*Assistant Examiner* — David Colon Morales
(74) *Attorney, Agent, or Firm* — The Ollila Law Group LLC

(57) ABSTRACT

A valve sub-base (100) is provided. The valve sub-base (100) includes a coupling system (200). The valve sub-base (100) includes a female coupling member (106*a*) formed on a first side (151) of the valve sub-base (100). The valve sub-base (100) also includes a male coupling member (106*b*) formed on a second side (152) of the valve sub-base (100) and configured to engage a corresponding female coupling member (106*a*) on an adjoining valve sub-base (100) to couple two or more valve sub-bases (100).

10 Claims, 9 Drawing Sheets

(56) References Cited

U.S. PATENT DOCUMENTS

| | | | | |
|---|---|---|---|---|
| 5,860,676 | A * | 1/1999 | Brzezicki et al. | 285/24 |
| 5,964,481 | A * | 10/1999 | Buch | 285/18 |
| 6,286,721 | B1 * | 9/2001 | Pellegrini | 222/129.1 |
| 6,394,138 | B1 * | 5/2002 | Vu et al. | 137/884 |
| 6,427,723 | B2 * | 8/2002 | Bogdanowicz et al. | 137/884 |
| 6,668,857 | B2 * | 12/2003 | Gagnon et al. | 137/539 |
| 6,688,325 | B2 * | 2/2004 | Hettinger | 137/270 |
| 6,892,764 | B2 * | 5/2005 | Rodrigues et al. | 137/884 |
| 6,951,226 | B2 * | 10/2005 | Eriksson et al. | 137/884 |
| 7,204,273 | B1 | 4/2007 | Zub et al. | |
| 7,806,143 | B2 * | 10/2010 | Taskar | 137/884 |
| 2001/0003289 | A1 * | 6/2001 | Mead et al. | 137/884 |
| 2007/0278436 | A1 * | 12/2007 | Phillips et al. | 251/129.03 |
| 2008/0224078 | A1 * | 9/2008 | Hecht | 251/129.15 |
| 2009/0023320 | A1 * | 1/2009 | De Carolis et al. | 439/190 |
| 2009/0045367 | A1 * | 2/2009 | Lee et al. | 251/129.15 |
| 2009/0139591 | A1 * | 6/2009 | Okamoto | 137/884 |

* cited by examiner

VALVE SUB-BASE

CROSS-REFERENCE TO RELATED APPLICATIONS

This is a National Stage entry of International Application No. PCT/EP2011/056806, with an international filing date of Apr. 28, 2011, which claims priority of U.S. patent application No. 61/330,985, filed May 4, 2010, entitled "Valve Sub-Base".

TECHNICAL FIELD

The present invention relates to, valve sub-bases, and more particularly, to valve sub-bases that may be coupled to one another on one or more sides using coupling members.

BACKGROUND OF THE INVENTION

Valve islands comprising two or more valves are known in the art. A valve island typically comprises two or more valves mounted on a common base with a common electrical wireway and/or fluid passage. The valves may include integral fittings that can receive tubing or other fluid connections or may comprise valve sub-base mountable valves wherein a valve sub-base forms a fluid-tight seal with the valve and provides some or all of the connection fittings. The valves are usually coupled using a manifold or the valve sub-base system. When the valves are coupled to a manifold system, the manifold can supply/deliver pressurized fluid to/from various ports of the valve. The valve can then control fluid communication between the various valve ports. The pressurized fluid may comprise a liquid, a gas, or a combination thereof. The manifold may also be in fluid communication with external components supplied with the pressurized fluid delivered from the valve island. Therefore, the manifold typically provides a communication interface for each of the valves. The manifold usually forms a fluid-tight seal with each of the valves on a first face and provides one or more nozzles, ports, or some other fluid communication interface on a second face. The manifold can also maintain the position of the valves relative to one another. A simplified figure of a prior art valve island including a manifold is shown in FIG. 1.

The prior art valve island 10 shown in FIG. 1 includes a manifold 11 coupled to a plurality of valves 12*a*-12*d*. Each of the plurality of valves 12*a*-12*d* includes one or more electrical contacts 5 in order to power the valves 12*a*-12*d* as is generally known in the art. The plurality of valves 12*a*-12*d* may be coupled to the manifold 11 using mechanical fasteners, brazing, bonding, adhesives, snap fit, friction fit, etc. The manifold 11 is typically coupled to the valves 12*a*-12*d* to form a fluid-tight seal. In FIG. 1, the valves 12*a*-12*d* form a fluid-tight seal with a bottom face 11*a* of the manifold 11. The manifold 11 also includes a plurality of nozzles 13. In FIG. 1, the nozzles 13 are formed on a top face 11*b*, which is substantially opposite the bottom face 11*a*. However, various configurations are known and the nozzles 13 may be formed on a side face of the manifold, for example. In the prior art valve island 10 shown in FIG. 1, each of the nozzles 13 includes a barb 14. The barbs 14 may be provided to aid in retaining conduits, tubing, and the like onto the nozzle 13, for example.

As shown in FIG. 1, the manifold 11 comprises a single molded component that is designed to receive four valves 12*a*-12*d* positioned in a single row, i.e., a 1×4 configuration. Therefore, the valve configuration of the manifold 11 is fixed. The manifold 11 is not capable of arranging the four valves

12*a*-12*d* in any other configuration. Therefore, if a user requires a different valve configuration due to limitations of fluid tubing or electrical wiring, for example, a new manifold is required. Further, the size of the nozzles 13 on the manifold 11 is generally fixed. Therefore, if different sizes are required due to the user's existing fluid connections, a whole new manifold may be required even though some of the nozzles 13 are appropriately sized. This rigid configuration creates a number of problems. Either the manufacturer is required to produce and stock numerous manifold configurations in order to accommodate a wide variety of customer requirements or the user is required to custom order a desired manifold. Neither situation is ideal because both result in increased costs associated with the chosen manifold, and thus, the valve island 10.

An alternative to using a manifold is to couple each valve to an individual valve sub-base. A valve sub-base can be coupled to a valve that lacks its own fluid fittings, for example. Therefore, the valve sub-bases typically include internal fluid passageways that can communicate pressurized fluid to and from a coupled valve. The valve sub-base can provide a fluid communication interface between the valve and a user's fluid connections. The valve sub-base typically includes nozzles, threaded fittings, threaded ports, etc. that are adapted to receive a fluid conduit, hose, or the like. Generally, a valve sub-base is coupled to a single valve or a limited number of valves. In order to form a valve island, the valve sub-bases can be connected together. Prior art systems are known that couple valve sub-bases. For example, U.S. Pat. No. 7,204,273 shows a valve island with valve sub-bases held together using bolts. The problem with using a valve sub-base as provided in the '273 patent is that like the manifold, the valve configuration is generally fixed. The valves can only be positioned in a single row. Further, coupling the valve sub-bases is cumbersome and time consuming as multiple bolts or fasteners are often used to hold the valve sub-bases together resulting in an excessive amount of time required to couple and de-couple multiple valve sub-bases. In addition, the valve sub-bases disclosed in the '273 patent utilize a passageway that travels through the side of each valve sub-base. Therefore, the user's fluid connection system must be able to accommodate the single row configuration. There is no way for the valve sub-base system shown in the '273 patent to be arranged with multiple adjoining rows. Rather, only a single row can be provided.

There exists a need for a valve sub-base system that can be coupled to adjoining valve sub-bases in order to create a valve island where the adjoining valve sub-bases resemble a manifold. Further, there exists a need for a valve sub-base system that includes multiple coupling members for coupling adjoining valve sub-bases on adjacent sides to create an adaptable configuration without requiring an excessive amount of assembly time. The valve sub-base system can thus be varied in order to accommodate a wide variety of user configurations.

SUMMARY OF THE INVENTION

A valve sub-base including a coupling system is provided according to an embodiment of the invention. According to an embodiment of the invention, the valve sub-base comprises a female coupling member formed on a first side of the valve sub-base. According to an embodiment of the invention, the valve sub-base also comprises a male coupling member formed on a second side of the valve sub-base and configured to engage a corresponding female coupling member on an adjoining valve sub-base to couple two or more valve sub-bases.

A valve system is provided according to an embodiment of the invention. The valve system comprises a valve including one or more fluid ports. According to an embodiment of the invention, the valve system also comprises a valve sub-base coupled to the valve and forming a fluid-tight seal with the one or more fluid ports. The valve sub-base includes one or more nozzles in fluid communication with the one or more fluid ports. The valve sub-base also includes a coupling system. The coupling system includes a female coupling member formed on a first side of the valve sub-base. The coupling system also includes a male coupling member formed on a second side of the valve sub-base and configured to engage a corresponding female coupling member formed on an adjoining valve sub-base.

A valve island is provided according to an embodiment of the invention. The valve island comprises a first valve and a first valve sub-base coupled to the first valve. The first valve sub-base comprises a female coupling member formed on a first side of the first valve sub-base and a male coupling member formed on a second side of the first valve sub-base. According to an embodiment of the invention, the valve island also comprises a second valve positioned proximate the first valve and a second valve sub-base coupled to the second valve. According to an embodiment of the invention, the second valve sub-base comprises a female coupling member formed on a first side of the second valve sub-base and a male coupling member formed on a second side of the second valve sub-base. The male coupling member formed on the second side of the second valve sub-base is configured to engage the female coupling member formed on the first side of the first valve sub-base.

ASPECTS

According to an aspect of the invention, a valve sub-base including a coupling system comprises:

- a female coupling member formed on a first side of the valve sub-base; and
- a male coupling member formed on a second side of the valve sub-base and configured to engage a corresponding female coupling member on an adjoining valve sub-base to couple two or more valve sub-bases.

Preferably, the valve sub-base further comprises:

- a second female coupling member formed on a third side of the valve sub-base; and
- a second male coupling member formed on a fourth side of the valve sub-base and configured to engage a corresponding second female coupling member formed on an adjoining valve sub-base.

Preferably, the valve sub-base further comprises:

- a male coupling member formed on the first side of the valve sub-base; and
- a female coupling member formed on the second side of the valve sub-base and configured to engage a corresponding male coupling member formed on an adjoining valve sub-base.

Preferably, the female coupling member comprises a channel and a lip and wherein the male coupling member comprises a tab configured to engage a corresponding channel formed on an adjoining valve sub-base and a rail configured to engage a corresponding lip formed on an adjoining valve sub-base.

According to another aspect of the invention, a valve system comprises:

- a valve including one or more fluid ports;
- a valve sub-base coupled to the valve and forming a fluid-tight seal with the one or more fluid ports, the valve sub-base including:
  - one or more nozzles in fluid communication with the one or more fluid ports;
  - a coupling system comprising:
    - a female coupling member formed on a first side of the valve sub-base; and
    - a male coupling member formed on a second side of the valve sub-base and configured to engage a corresponding female coupling member formed on an adjoining valve sub-base.

Preferably, the valve system further comprises:

- a second female coupling member formed on a third side of the valve sub-base; and
- a second male coupling member formed on a fourth side of the valve sub-base and configured to engage a corresponding second female coupling member formed on an adjoining valve sub-base.

Preferably, the valve system further comprises:

- a male coupling member formed on the first side of the valve sub-base; and
- a female coupling member formed on the second side of the valve sub-base and configured to engage a corresponding male coupling member formed on an adjoining valve sub-base.

Preferably, the female coupling member comprises a channel and a lip and wherein the male coupling member comprises a tab configured to engage a corresponding channel formed on an adjoining valve sub-base and a rail configured to engage a corresponding lip formed on an adjoining valve sub-base.

Preferably, the valve system further comprises a fastener receiver formed in the valve sub-base and configured to receive a fastener to retain the valve sub-base coupled to the valve.

According to another aspect of the invention, a valve island comprises:

- a first valve;
- a first valve sub-base coupled to the first valve and including:
  - a female coupling member formed on a first side of the first valve sub-base;
  - a male coupling member formed on a second side of the first valve sub-base;
- a second valve positioned proximate the first valve;
- a second valve sub-base coupled to the second valve and including:
  - a female coupling member formed on a first side of the second valve sub-base;
  - a male coupling member formed on a second side of the second valve sub-base and configured to engage the female coupling member formed on the first side of the first valve sub-base.

Preferably, the valve island further comprises:

- a female coupling member formed on a third side of the first valve sub-base; and
- a male coupling member formed on a fourth side of the first valve sub-base;
- a third valve positioned proximate the first valve;
- a third valve sub-base coupled to the third valve and including:
  - a female coupling member formed on a third side of the third valve sub-base; and a male coupling member formed on a fourth side of the third valve sub-base and configured to engage the female coupling member formed on the third side of the first valve sub-base.

Preferably, the valve island further comprises:

a male coupling member formed on the first side of the first valve sub-base;

a female coupling member formed on the second side of the first valve sub-base;

a male coupling member formed on the first side of the first valve sub-base; and a female coupling member formed on the second side of the second valve sub-base and configured to engage the male coupling member formed on the first side of the first valve sub-base.

Preferably, the female coupling member formed on the first side of the first valve sub-base comprises a channel and a lip and wherein the male coupling member formed on the second side of the second valve sub-base comprises a tab configured to engage the channel and a rail configured to engage the lip.

DETAILED DESCRIPTION OF THE INVENTION

FIGS. 2-9 and the following description depict specific examples to teach those skilled in the art how to make and use the best mode of the invention. For the purpose of teaching inventive principles, some conventional aspects have been simplified or omitted. Those skilled in the art will appreciate variations from these examples that fall within the scope of the invention. Those skilled in the art will appreciate that the features described below can be combined in various ways to form multiple variations of the invention. As a result, the invention is not limited to the specific examples described below, but only by the claims and their equivalents.

Figure 1:
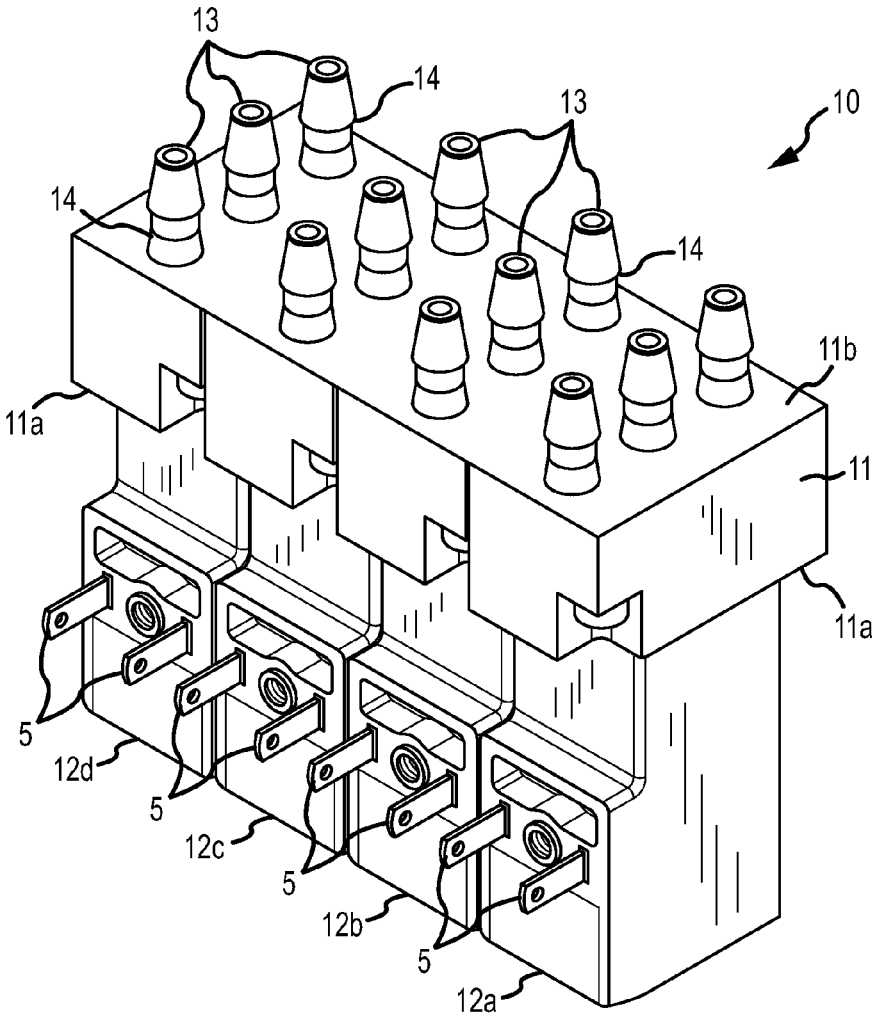
FIG. 1 (PRIOR ART)
FIG. 1 shows a prior art valve and manifold system.
Figure 2:
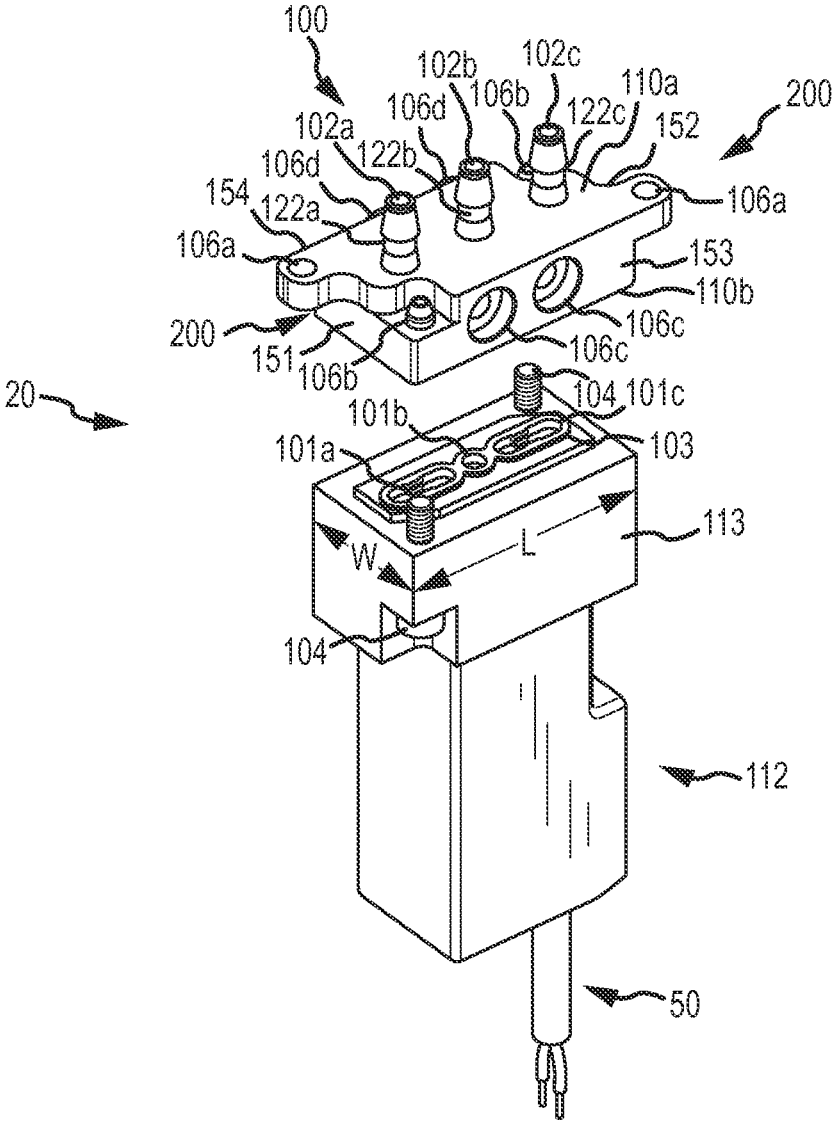
FIG. 2 shows a valve system with a valve and a valve sub-base with first and second coupling members according to an embodiment of the invention.
Figure 3:
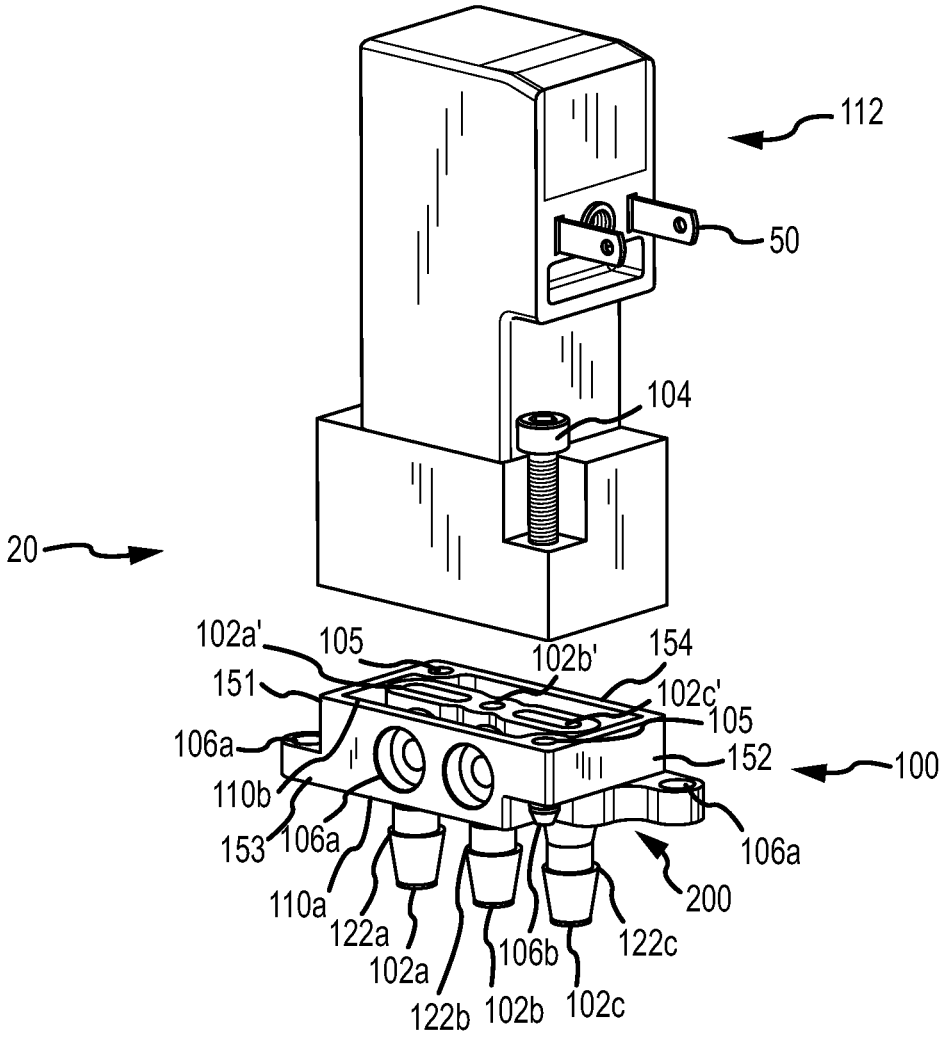
FIG. 3 shows a valve system with a valve and a valve sub-base with first and second coupling members according to another embodiment of the invention.

FIGS. 2 & 3 show a valve sub-base 100 according to an embodiment of the invention. FIGS. 2 & 3 also show a valve 112, which is similar to the valve 12 shown in the prior art FIG. 1. Together, the valve sub-base 100 and the valve 112 form a valve system 20. The valve system 20 is capable of coupling to adjoining valve systems 20 as described in more detail below. Further, with the valve sub-base 100 coupled to the valve 112, the valve system 20 can be coupled to fluid connections (not shown) and the valve 112 can control fluid communication between the fluid connections. The valve 112 may comprise an electrically actuated valve, such as a solenoid-actuated valve, a piezo-actuated valve, etc. Alternatively, the valve 112 may comprise a fluid actuated valve, for example. The particular type of valve used should in no way limit the scope of the present invention. As shown, the valve 112 comprises a housing 113. The valve 112 also comprises a length, L, and a width, W. It should be appreciated that the length may be longer than the width, the same length, or the length may be shorter than the width. The orientation of the length and width of the valve 112 is merely provided in order to aid in the orientation of the valve 112 with respect to various other components described in more detail below.

The valve sub-base 100 is shown de-coupled from the valve 112. As can be appreciated, the valve sub-base 100 may be adapted to engage a portion of the valve 112 and form a substantially fluid-tight seal with the valve 112, thereby forming a valve system 20 capable of communicating with fluid conduits, hoses, etc. According to the embodiment shown, the valve sub-base 100 is adapted to engage the valve housing 113 of the valve 112. Therefore, it should be appreciated that the valve sub-base 100 may be provided in some embodiments where the valve 112 lacks its own fittings or other connections adapted to receive fluid conduits, hoses, etc. For example, the valve 112 shown in FIGS. 2 and 3 comprises ports 101*a*-101*c*, which may not be suitable for forming a fluid-tight seal with a user's fluid connections. According to another embodiment of the invention, the valve sub-base 100 may be implemented in embodiments where the valve 112 may include fluid fittings; however, the valve's fluid fittings are not a desired size and/or shape. Therefore, the valve sub-base 100 may be coupled to the valve 112 in order to adjust the size of the fluid fittings to accommodate various fluid connections.

According to an embodiment of the invention, the valve 112 includes one or more electrical connections 50 adapted to communicate power to the valve 112 in order to operate the valve 112 as is generally known in the art. The electrical connection 50 may also be capable of supplying a signal to a controller (not shown) or other processing device. For example, an operational state of the valve 112 may be supplied via electrical connection 50. While a single electrical connection 50 is shown in the figures, it should be appreciated that more than one electrical connection may be provided. The electrical connection 50 is shown in FIG. 2 as comprising wires whereas in FIG. 3, the electrical connection 50 is shown as comprising a plug; other electrical connections are possible.

According to an embodiment of the invention, the valve 112 also includes one or more fluid ports 101*a*, 101*b*, 101*c*. According to an embodiment of the invention, the three ports shown in FIG. 2 may comprise a fluid input port 101*a*, a fluid output port 101*c*, and an exhaust port 101*b*. It should be appreciated that while the valve 112 is shown as comprising three fluid ports, other configurations are certainly possible. For example, the valve 112 shown in the figures may comprise a 3/2 valve and other valves such as a 5/2 valve, for example, may be used without departing from the scope of the present invention. Therefore, the particular number of fluid ports should not limit the scope of the present invention. According to an embodiment of the invention, the fluid ports 101*a*-101*c* are provided in a single row that extend along the length of the valve 112; however, other configurations are certainly possible.

According to an embodiment of the invention, the valve sub-base 100 is configured to couple to the valve 112 such that a substantially fluid-tight seal is formed between the valve sub-base 100 and each of the fluid ports 101*a*, 101*b*, 101*c*. As shown, the valve 112, the valve sub-base 100, or both can comprise one or more sealing members 103. Alternatively, the sealing member 103 may comprise a separate component positioned between the valve 112 and the valve sub-base 100. According to the embodiment shown, a single sealing member 103 is supplied that provides the fluid-tight seal for each of the fluid ports 101*a*, 101*b*, 101*c*. The sealing member 103 may comprise an elastomeric seal, an O-ring seal, etc. Therefore, the particular type of seal used should not limit the scope of the present invention.

According to an embodiment of the invention, the valve sub-base 100 can include one or more fluid nozzles 102*a*-102*c* corresponding to the valve ports 101*a*, 101*b*, 101*c* of the valve 112. According to an embodiment of the invention, each nozzle 102*a*-102*c* can include one or more barbs 122*a*-122*c*, similar to the prior art barbs 14 described above and shown in FIG. 1. According to an embodiment of the invention, the one or more fluid nozzles 102*a*-102*c* can be in fluid communication with the valve ports 101*a*-101*c*. As shown in FIG. 3, the valve sub-base 100 can include apertures 102*a*', 102*b*', 102*c*' that are in fluid communication with the nozzles 102*a*, 102*b*, 102*c*, respectively. The apertures 102*a*'-102*c*' may be in fluid communication with the nozzles 102*a*-102*c* via internally formed fluid passages (not shown), for example. According to an embodiment of the invention, the apertures 102*a*'-102*c*' are configured to align with the fluid ports 101*a*-101*c* of the valve 112. According to an embodiment of the invention, the nozzles 102*a*-102*c* can be formed on a first face 110A of the valve sub-base 100 and the apertures 102*a*'-102*c*' can be formed on a second face 110B of the valve sub-base 100. In the embodiment shown, the first and second faces 110A, 110B can be substantially opposite one another. In other embodiments, the first and second faces 110A, 110B may be adjoining faces, i.e., at approximately right angles. Therefore, the particular configuration shown in the figures should in no way limit the scope of the present invention.

According to the embodiment shown in FIGS. 2 & 3, the valve sub-base 100 can be coupled to the valve 112 using one or more fastener members 104. In the embodiment shown, the fastener members 104 comprise bolts. However, it should be appreciated that the fastener members 104 may comprise other configurations such as rivets, screws, nuts, or the like. It should also be appreciated that the valve sub-base 100 may be coupled to the valve 112 according to other well-known methods, such as adhesives, brazing, bonding, welding, friction fit, snap-fit, etc. Therefore, the particular method used for coupling the valve sub-base 100 to the valve 112 should in no way limit the scope of the present invention. According to an embodiment of the invention, the mechanical fasteners 104 are adapted to engage a fastener receiver 105 formed in the valve sub-base 100 (See FIG. 3). More particularly, the fastener receiver 105 is formed in the second face 110B of the valve sub-base 100. According to the embodiment shown, the fastener receiver 105 comprises a threaded aperture having threads corresponding to the threads formed on the mechanical fastener 104. However, other types of fastener receivers 105 may be provided depending on the particular method used to couple the valve sub-base 100 to the valve 112. According to an embodiment of the invention, the mechanical fastener 104 can engage the fastener receiver 105 in order to maintain a fluid-tight seal between the valve 112 and the second face 110B of the valve sub-base 100. More particularly, a fluid-tight seal can be formed between the fluid ports 101*a*-101*c* and the apertures 102*a*'-102*c*'. With the valve sub-base 100 coupled to the valve 112, multiple valves 112 may be coupled using corresponding valve sub-bases 100 in order to form a valve island as described in more detail below.

Furthermore, with the valve sub-base 100 coupled to the valve 112, various fluid connections (not shown) may be coupled to the nozzles 102*a*-102*c* of the valve sub-base 100 with the valve 112 controlling fluid communication between the various nozzles 102*a*-102*c* and thus, the fluid connections. It should be appreciated that the valve 112 may be adapted to engage various different valve sub-bases 100 having nozzles 102*a*-102*c* of different sizes and/or shapes in order to accommodate various fluid connection configurations. Therefore, the valve 112 may realize a wider utility than in the prior art.

According to an embodiment of the invention, the valve sub-base 100 comprises a coupling system 200. According to an embodiment of the invention, the coupling system 200 comprises two or more coupling members 106. According to an embodiment of the invention, the coupling system 200 comprises an interlocking coupling system. An interlocking coupling system 200 allows two or more complementary coupling components to engage one another and to be held together due to their complementary shapes and sizes. A coupling member 106 on a valve sub-base 100 is configured to engage a corresponding coupling member 106 on an adjoining valve sub-base 100. According to the embodiment shown in FIG. 2, the valve sub-base 100 includes one or more first valve sub-base coupling members 106*a* and one or more second valve sub-base coupling members 106*b*. According to an embodiment of the invention, a first coupling member 106*a* is formed on a first side 151 of the valve sub-base 100. According to an embodiment of the invention, the first coupling member 106*a* comprises a female coupling member. According to an embodiment of the invention, a second coupling member 106*b* is formed on a second side 152 of the valve sub-base 100. According to an embodiment of the invention, the second coupling member 106*b* comprises a male coupling member. According to the embodiment shown, the first side 151 and the second side 152 comprise first and second coupling members 106*a*, 106*b*. According to an embodiment of the invention, the first and second valve sub-base coupling members 106*a*, 106*b* comprise integral components of the valve sub-base 100. In other words, the first and second coupling members 106*a*, 106*b* may be formed as part of the valve sub-base 100 rather than comprising an externally attached component.

According to an embodiment of the invention, a first valve sub-base coupling member 106*a* provided on a first side 151 of a first valve sub-base 100 is adapted to engage a second valve sub-base coupling member 106*b* provided on an adjoining valve sub-base 100 when two valve sub-bases are positioned proximate one another. The second valve sub-base coupling member 106*b* may be provided on a first side or a second side of the adjoining valve sub-base 100. However, it should be appreciated that a single valve sub-base 100 can include one or more first coupling members 106*a* and one or more second coupling members 106*b*. In the embodiment shown in FIGS. 2 & 3, the first valve sub-base coupling member 106*a* comprises a female coupling member while the second valve sub-base coupling member 106*b* comprises a male coupling member, wherein the female coupling member is adapted to receive at least a portion of the male valve sub-base coupling member 106*b*. According to an embodiment of the invention, the first and second coupling members 106*a*, 106*b* are adapted to engage one another using an interlocking fitting. As a result, once engaged, the coupling members 106*a*, 106*b* can retain adjoining valve sub-bases 100 in a desired configuration.

According to the embodiment shown in FIGS. 2 & 3, in addition to the first and second coupling members 106*a*,

106*b*, the valve sub-base 100 also comprises third and fourth coupling members 106*c*, 106*d*. According to an embodiment of the invention, the third coupling member 106*c* comprises a female coupling member and the fourth coupling member 106*d* comprises a male coupling member. According to an embodiment of the invention, the third coupling member 106*c* is formed on a third side 153 of the valve sub-base 100 and the fourth coupling member 106*d* is formed on a fourth side 154 of the valve sub-base 100. While the first and second sides 151, 152 are shown as being shorter than the third and fourth sides 153, 154, it should be appreciated that in other embodiments, the first and second sides 151, 152 may be longer than or the same length as the third and fourth sides 153, 154. The fourth coupling member 106*d* is difficult to see in FIGS. 2 & 3 and is shown better in FIGS. 4, 6, and 8. According to an embodiment of the invention, the first and second coupling members 106*a*, 106*b* are provided to couple the valve sub-base 100 with the widths, W of the valves 112 facing one another, i.e., the first and second sides 151, 152 coupled together. According to an embodiment of the invention, the third and fourth coupling members 106*c*, 106*d* are provided to couple the valve sub-base 100 with the lengths, L of the valve 112 facing one another, i.e., the third and fourth sides 153, 154 coupled. According to an embodiment of the invention, the third coupling member 106*c* is adapted to receive at least a portion of the fourth coupling member 106*d*. The third coupling member 106*c* is shown as comprising an aperture (female coupling member) while the fourth coupling member 106*d* comprises a protrusion (male coupling member) adapted to at least partially fit within the third coupling member 106*c*.

Figure 4:
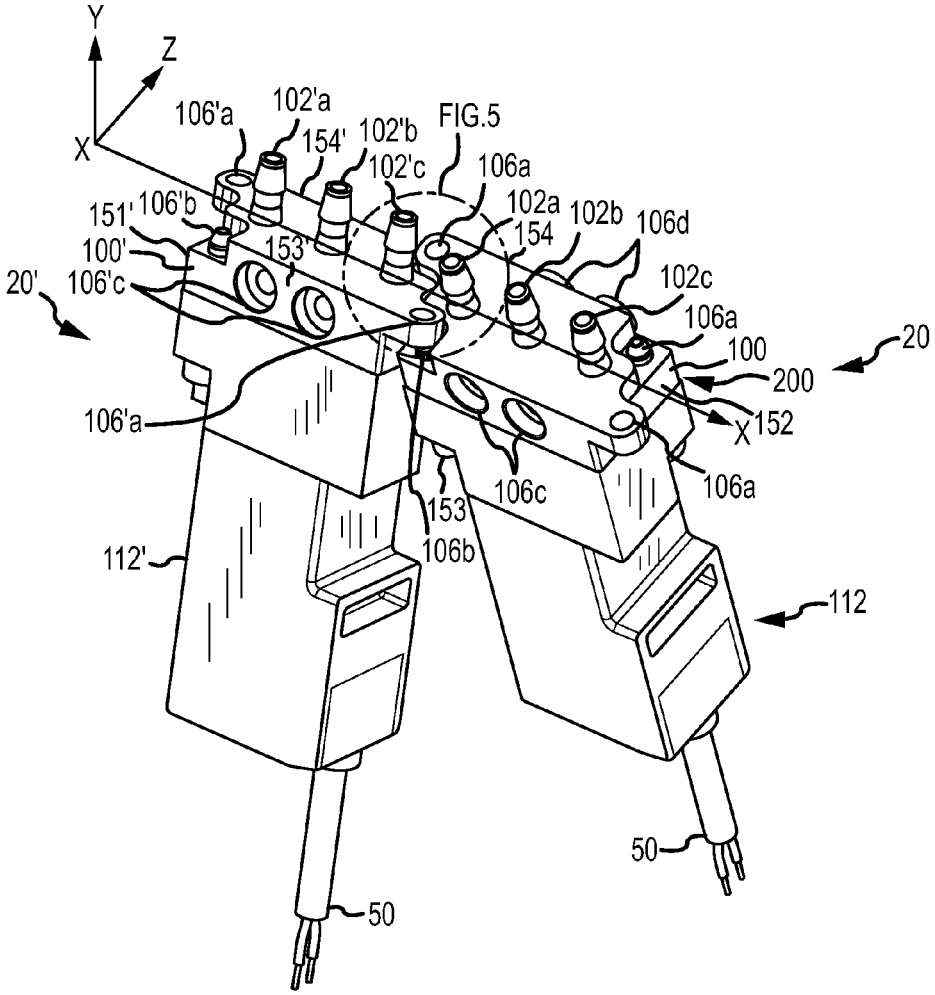
FIG. 4 shows two adjoining valve systems.

FIG. 4 shows two valve systems 20 and 20' ready to engage one another according to an embodiment of the invention. The valve system 20' on the left comprises essentially the same components as the valve system 20 on the right; however, components corresponding to the valve system 20' on the left are designated with a prime (') at the end of the number. When components are described in general and are not referring to a specific valve system or valve sub-base, the prime (') is omitted. In the embodiment shown in FIG. 4, each of the valve sub-bases 100, 100' are coupled to a valve 112, 112' as described above. Therefore, the valve sub-bases 100 may be configured to communicate pressurized fluid to/from the valve 112, using nozzles 102*a*-102*c*, with the valves 112, controlling fluid communication between the various nozzles 102*a*-102*c*, for example.

According to the embodiment shown in FIG. 4, the valve systems 20, 20' are brought together such that a width side of each of the valves 112, 112' faces one another. In other words, the first and second sides 151, 152' of the adjoining valve sub-bases 100, 100' are brought together. As shown, the valve system 20 is rotated relative to the valve system 20' along a common axis of rotation x-x that runs parallel to the length, L of the valve 112, 112'. As a result, the first and second valve sub-base coupling members 106*a*, 106*b*, 106'*a*, 106'*b* are positioned proximate one another. Rotating the valve sub-bases 100, 100' relative to one another allows the second coupling member 106*b* on the first side 151 of the first valve sub-base 100 to be positioned under the first coupling member 106'*a* on the second side 152' of the second valve sub-base 100' while positioning the first coupling member 106*a* on the first side 151 of the first valve sub-base 100 over the second coupling member 106'*b* on the second side 152' of the second valve sub-base 100'. This is shown in more detail in FIG. 5.

Figure 5:
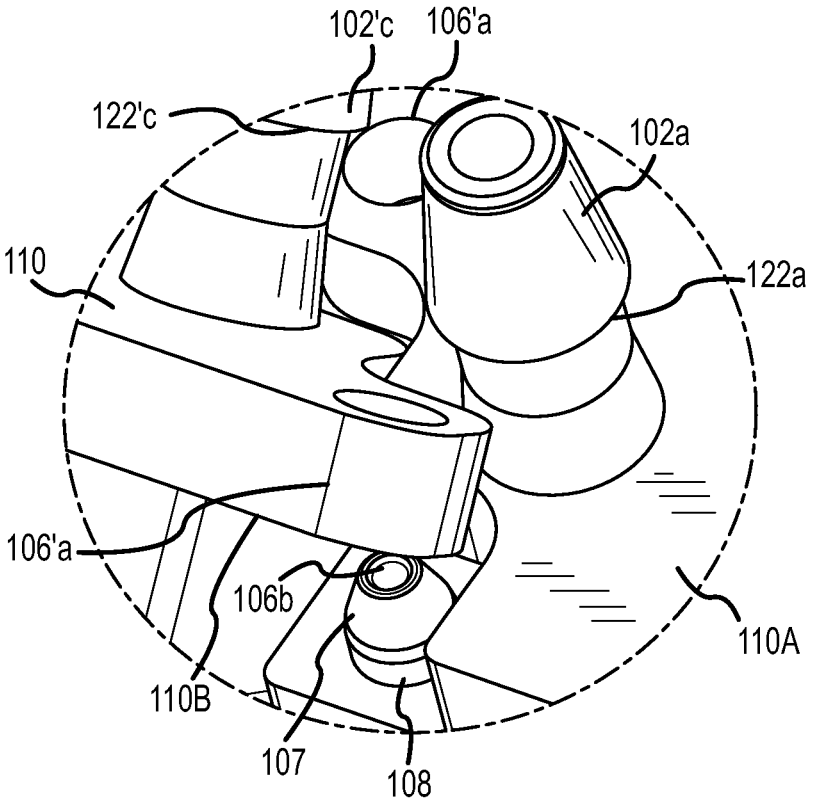
FIG. 5 shows first and second coupling members prior to engagement.

FIG. 5 shows the first and second coupling members 106*a*, 106*b* of adjoining valve sub-bases 100 ready to engage one another. With the valve sub-bases 100 rotated relative to one another, the first and second coupling members 106*a*, 106*b* can be brought together with the second coupling member 106*b* aligned with the first coupling member 106*a*. If the valve sub-bases 100 shown in FIG. 5 were rotated back to where the first faces 110A of the valve sub-bases 100 are in a single plane, the first and second valve sub-base coupling members 106*a*, 106*b* could engage one another.

According to one embodiment of the invention, the first and second coupling members 106*a*, 106*b* can engage one another using an interlocking fitting as shown. For example, according to an embodiment of the invention, the first coupling member 106*a* is adapted to receive at least a portion of the second coupling member 106*b*, of an adjoining valve sub-base to interlock the first and second coupling members 106*a*, 106*b*. As a result, once the second coupling member 106*b* is received by the first coupling member 106*a*, movement of the valve sub-bases 100 relative to one another is restricted in one or more directions by the interlocking engagement. For example, in the embodiment shown, the coupling members 106*a*, 106*b* restrict movement of the valve sub-bases 100 in the x-direction, the y-direction, and the z-direction according to the coordinate system shown in FIG. 4. However, upon rotating the valve sub-bases 100 as shown, the coupling members 106*a*, 106*b* can disengage and the valve sub-bases 100 can be separated from one another. In the coordinate system shown, the x-direction is parallel to the length, L of the valve 112, the z-direction is parallel to the width, W of the valve 112 and the y-direction is perpendicular to the x-direction and the y-direction.

According to an embodiment of the invention, although interlocked with one another, the first coupling member 106*a* may be able to move relatively freely within the second coupling member 106*b*. The corresponding shapes of the coupling members 106*a*, 106*b* can hold the valve sub-bases 100, 100' together. According to another embodiment, the first and second coupling members 106*a*, 106*b* may engage and interlock one another in a snap-fit arrangement. For example, upon inserting the second coupling member 106*b* into the first coupling member 106*a*, one or both of the coupling members 106*a*, 106*b* may partially deform prior to reaching full engagement. Therefore, a predetermined force may be required to engage the first and second coupling members 106*a*, 106*b*. Once fully engaged, disengagement may require a predetermined force in order to once again partially deform one or both of the coupling members 106*a*, 106*b*. The predetermined force required to disengage the first and second coupling members 106*a*, 106*b* may be substantially the same force required to engage the coupling members 106*a*, 106*b* or may comprise a different force. Preferably, in this embodiment, the coupling members 106*a*, 106*b* are resilient such that they return to substantially their original shape after partially deforming.

According to another embodiment of the invention, the first and second coupling members 106*a*, 106*b* of adjoining valve sub-bases 100 may interlock one another in a friction fit arrangement. For example, as shown in FIG. 5, the second coupling member 106*b* comprises a first portion 107 and a second portion 108. According to an embodiment of the invention, the first portion 107 comprises a portion of reduced size. According to an embodiment of the invention, the first portion 107 comprises an outer cross-sectional area that is substantially smaller than a cross-sectional area of the inside of the first coupling member 106*a*. As a result, the first portion 107 can aid in alignment of the first and second coupling members 106*a*, 106*b*. Once the first and second coupling members 106*a*, 106*b* of adjoining valve sub-bases 100 are aligned, further engagement of the first and second coupling members 106*a*, 106*b* engages the first coupling member 106*a* with the second portion 108 of the second coupling member 106*b*. According to an embodiment of the invention, an outer cross-sectional area of the second portion 108 is substantially equal to the cross-sectional area of the inner surface of the first coupling member 106*a*. As a result, the friction fit between the first and second coupling members 106*a*, 106*b* can retain the coupling between the first and second valve sub-bases 100, 100'. A predetermined force may be required to fully engage and disengage the first and second coupling members 106*a*, 106*b* in order to overcome the frictional force. Other methods may be used to retain the coupling members 106*a*, 106*b* together, such as adhesives, brazing, bonding, etc. Therefore, the present invention should not be limited to snap-fit or friction fit arrangements.

It should be appreciated that in some embodiments, the first and second valve sub-base coupling members 106*a*, 106*b* provide a system for coupling adjoining valve sub-bases together without requiring additional fasteners as in the prior art systems. Rather, according to an embodiment of the invention, the first and second coupling members 106*a*, 106*b* may comprise integral components of the valve sub-base 100. The first and second coupling members 106*a*, 106*b* may therefore allow for much faster and easier coupling of valve sub-bases 100 to one another. Further, due to the configuration of the first and second valve sub-base coupling members 106*a*, 106*b*, the orientation of the valve systems 20 may be changed with respect to one another. For example, in the embodiment shown, the first nozzle 102*a* of the first valve system 20 is adjacent the third nozzle 102'*c* of the second valve system 20', i.e., the first side 151 of the first valve sub-base 100 is adjacent the second side 152' of the second sub-base 100'. However, due to the configuration of the valve sub-base 100, and more particularly, the multiple first and second coupling members 106*a*, 106*b* provided on the valve sub-base 100, the first valve system 20 could be rotated 180° such that the third nozzle 102*c* of the first valve system 20 is positioned adjacent the third nozzle 102'*c* of the second valve system 20'. This may be required or desired by a user due to the particular conduit configuration of an existing fluid connection system, for example.

Figure 6:
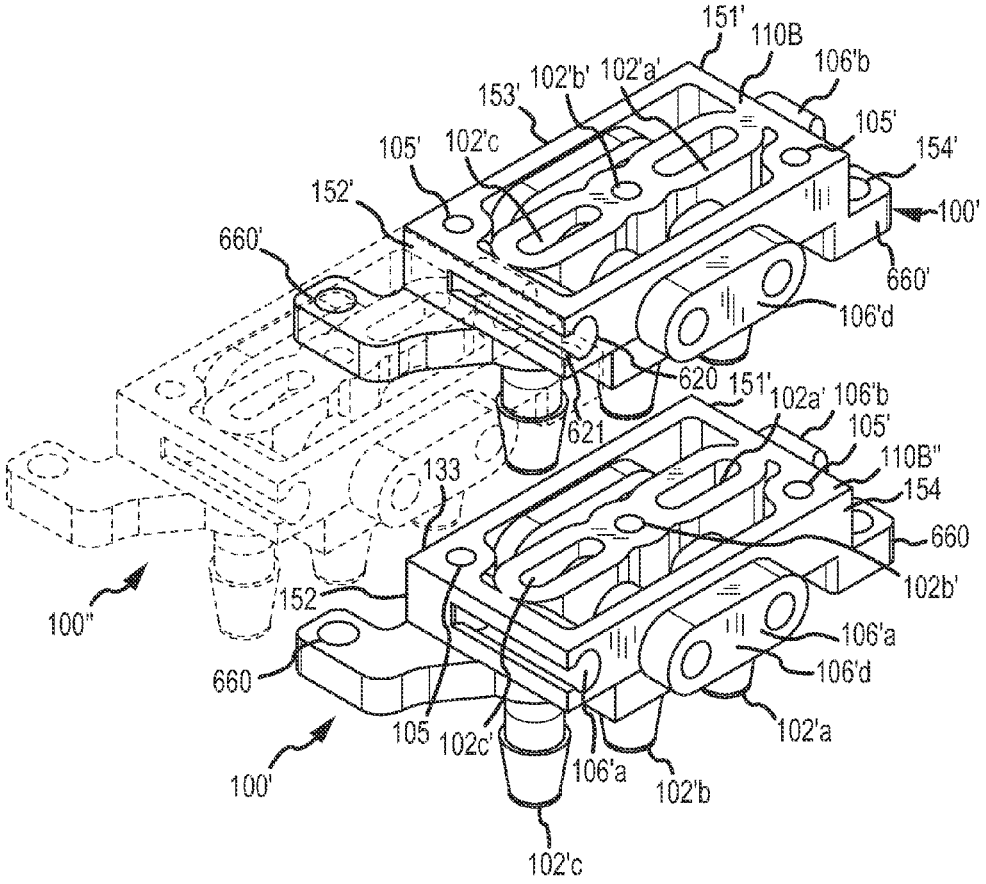
FIG. 6 shows a valve sub-base with first and second coupling members according to an embodiment of the invention.
Figure 7:
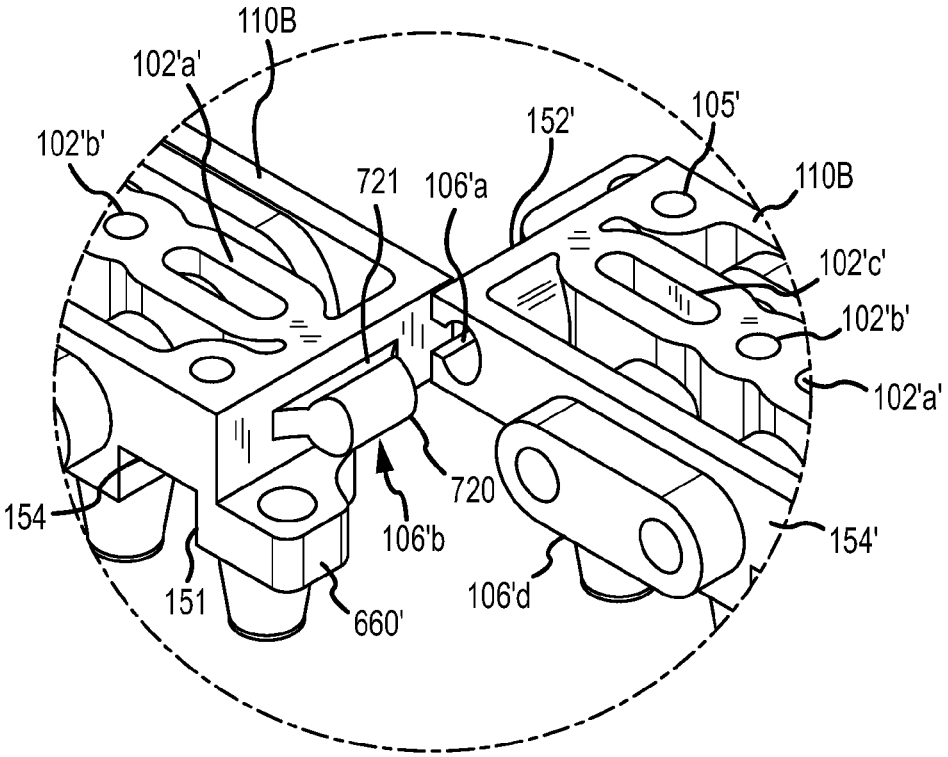
FIG. 7 shows first and second coupling members prior to engagement.

FIGS. 6 & 7 show two adjoining valve sub-bases 100, 100' according to another embodiment of the invention. In the embodiment shown in FIGS. 6 & 7, the valves 112 have been removed in order to simplify the drawing. However, it should be appreciated that in use, valves 112 could be coupled to the valve sub-bases 100, 100' as described above. In the embodiment shown in FIGS. 6 & 7, the first coupling member 106*a* of the second valve sub-base 100' is adapted to engage the second coupling member 106'*b* of the first valve sub-base 100. Specifically, the first and second coupling members 106'*a*, 106*b* are adapted to interlock one another. More specifically, the first coupling member 106'*a* is adapted to receive at least a portion of the second coupling member 106*b* in order to interlock the two valve sub-bases 100, 100' together. The second coupling member 106*b* is shown as being adapted to slide within the first coupling member 106'*a*. In FIG. 6, a valve sub-base 100" is shown, in phantom lines, fully engaged with the valve sub-base 100' at the top of the drawing. As shown in FIG. 6, the first coupling member 106'*a* comprises a channel 620' that ends at a lip 621'. According to an embodiment of the invention, at least a portion of the second coupling member 106*b* is adapted to slide within the channel 620'.

FIG. 7 shows a closer view of the two valve sub-bases 100, 100' with the coupling members 106'*a*, 106*b* aligned but prior to engagement. As can be seen, the second coupling member 106*b* comprises a tab 720 and a rail 721. According to an embodiment of the invention, the tab 720 is sized such that the tab 720 can fit within the channel 620' of the first coupling member 106'*a* but cannot fit in the lip 621'. According to an embodiment of the invention, the rail 721 is sized and shaped such that the rail 721 can fit within the lip 621' of the first coupling member 106'*a*. As a result, upon engagement of the first and second coupling members 106'*a*, 106*b*, the tab 720 of the second coupling member 106*b* is received by the channel 620' of the first coupling member 106'*a*. Simultaneously, the rail 721 of the second coupling member 106*b* is received by the lip 621' of the first coupling member 106'*a*. As a result, upon engagement, the tab 720 is restricted from moving in directions perpendicular to the direction of insertion. In other words, using the coordinate system displayed in FIG. 4, the interlocking fitting of the first and second coupling members 106'*a*, 106*b* substantially prevents the valve sub-bases 100, 100' from pulling apart in the x-direction and the y-direction. Further, the interlocking fitting between the first and second coupling members 106'*a*, 106*b* may comprise a friction fit. As a result, a predetermined threshold force may be required to pull the valve sub-bases 100, 100' apart in the z-direction as well.

According to an embodiment of the invention, the valve sub-bases 100, 100' may also include retainers 660, 660'. The retainers 660, 660' may be provided in some embodiments to receive mechanical fasteners (not shown) that can retain the valve sub-bases 100, 100' to a fluid distribution system, a mounting base, or the like.

The above description provides for coupling valve sub-bases 100, 100' along their first and second sides 151, 152' such that a single row of nozzles 102 is provided. According to other embodiments, the valve sub-bases 100 may be coupled along their third and fourth sides 153, 154 to form multiple rows as shown in FIG. 8.

Figure 8:
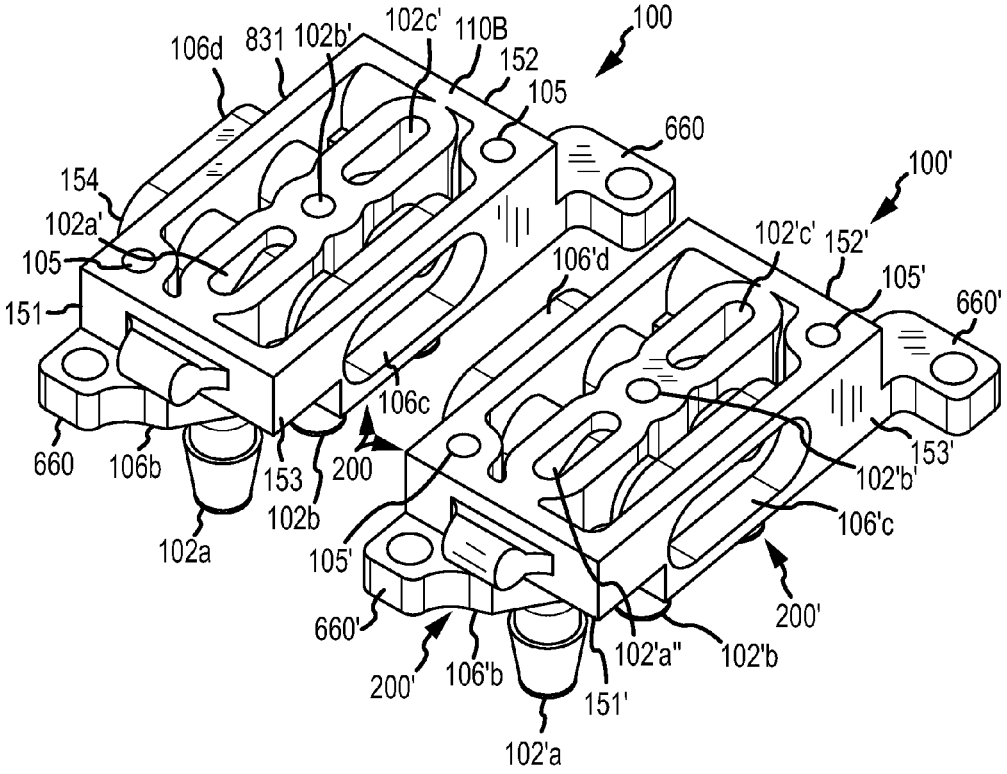
FIG. 8 shows a valve sub-base with first and second coupling members according to another embodiment of the invention.

FIG. 8 shows two valve sub-bases 100, 100" according to another embodiment of the invention. It should be appreciated that the valve sub-base 100" comprises substantially the same components as the first and second valve sub-bases 100, 100' described above; however, the valve sub-base 100" is shown as engaging the third side 153 of the first valve 100 rather than the first side 151 of the first valve 100. Therefore, the description below may omit the double prime (") when referring to a component in general and not specific to a certain valve sub-base. According to the embodiment shown in FIG. 8, in addition to the coupling members 106*a*, 106*b* described in FIGS. 6 & 7, each of the valve sub-bases 100, 100" also includes third and fourth coupling members 106*c*, 106*d*, formed on third and fourth sides 153, 154, respectively. As a result, the third and fourth coupling members 106*c*, 106*d* can be used to couple valve sub-bases 100 together to form more than one row of valve sub-bases. For example, the valve sub-bases 100 shown in FIG. 8 can be coupled as described above and shown in FIGS. 6 & 7, and can be coupled such that the length of the valves 112 face one another.

According to an embodiment of the invention, the third and fourth sides 153, 154 of the valve sub-base 100 can include one or more coupling members 106*c*, 106*d*. According to an embodiment of the invention, the third side 153 can comprise a third coupling member 106*c* while the fourth side 154, substantially opposite the third side 153, can comprise a fourth coupling member 106*d*. According to the embodiment shown, the third coupling member 106*c* is adapted to receive at least a portion the fourth coupling member 106*d* of an adjoining valve sub-base to interlock the third and fourth coupling members 106*c*, 106*d*. With the third and fourth coupling members 106*c*, 106*d* fully engaged, the third side 153 of a first valve sub-base 100 can be held in contact with the fourth side 154 of the third adjoining valve sub-base 100". As a result, valves 112 associated with each of the valve sub-bases 100 can be aligned in the direction of their widths, W, i.e., the lengths of the valve 112 can face one another.

According to an embodiment of the invention, the third and fourth coupling members 106*c*, 106*d* may engage and interlock one another in a snap-fit or a friction-fit, for example. Alternatively, the coupling members 106*c*, 106*d* may be held in engagement using adhesives, brazing, bonding, welding, etc. Another alternative may use mechanical fasteners (not shown) to hold the third and fourth coupling members 106*c*, 106*d* in engagement with one another.

Figure 9:
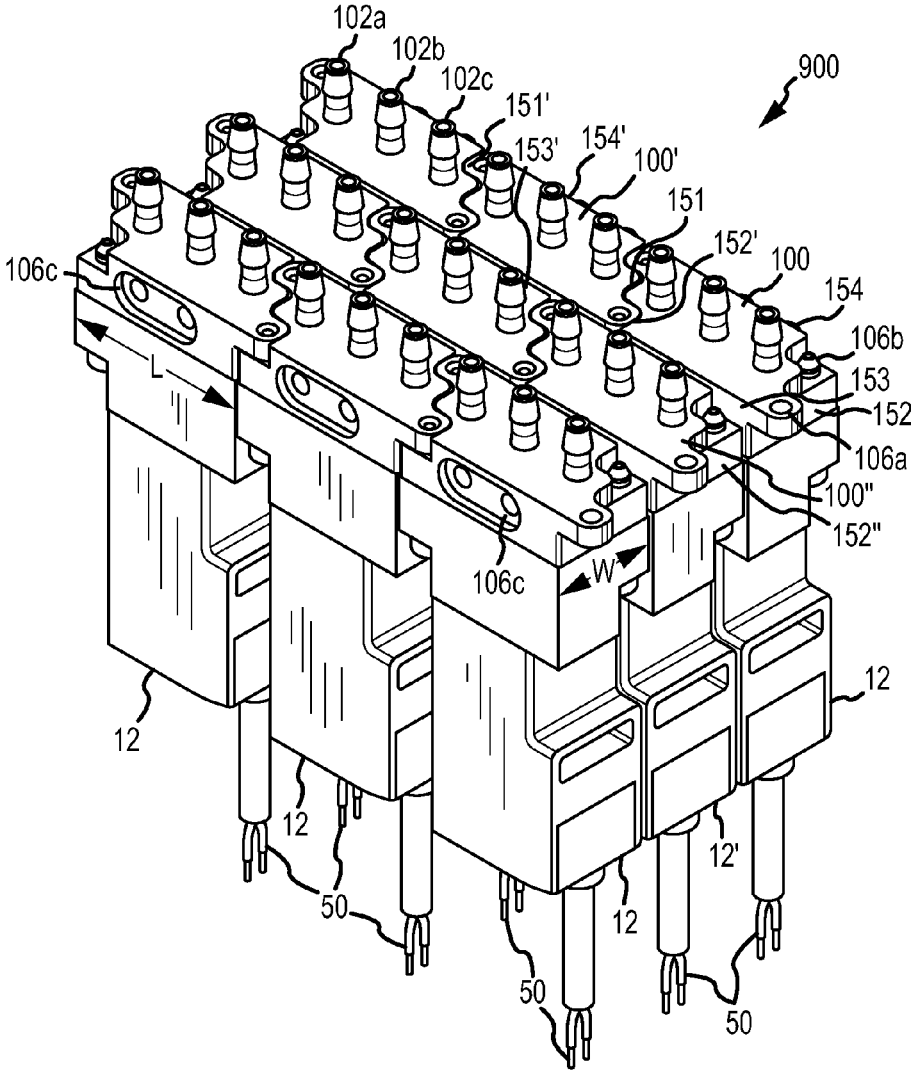
FIG. 9 shows a valve island with multiple valve sub-bases coupled to form a matrix according to an embodiment of the invention.

FIG. 9 shows a valve island 900 according to an embodiment of the invention. According to the embodiment shown, the valve island 900 comprises a 3×3 matrix formed by coupling valve sub-bases 100 together as described above. However, more or less sub-bases may be added or removed as described above. Three of the valve sub-bases 100, 100', 100" are labeled to aid in the understanding of the orientation of the valve sub-bases as described above. Therefore, it can be seen that the first valve sub-base 100 is coupled to the second valve sub-base 100' on a first side 151 and is coupled to the third valve sub-base 100" on the third side 153 as described above. The valve island 900 will be described as columns, which comprise coupling first and second sides 151, 152 of valve sub-bases 100 and rows, which comprise coupling third and fourth sides 153, 154 of valve sub-bases 100. According to the embodiment shown, the valve sub-bases 100 have been coupled using integral coupling members 106*a*, 106*b*, 106*c*, 106*d*, for example. Thus, the integral coupling members form a part of the sub-bases. As shown, the valve sub-bases 100 comprise the first and second coupling members 106*a*, 106*b* shown in FIGS. 2-5 as well as the third and fourth coupling members 106*c*, 106*d* shown in FIG. 8. Therefore, the valve sub-bases 100 can be coupled in at least two directions. According to an embodiment of the invention, the valve sub-bases 100 can be coupled into columns prior to being coupled into rows. This allows for the rotation of the valve sub-bases 100 relative to one another as described above. According to an embodiment of the invention, once two adjoining columns are formed, the two columns can be coupled using the third and fourth coupling members 106*c*, 106*d* described in FIG. 8. Alternatively, if the first and second coupling members 106*a*, 106*b* are similar to the embodiments shown in FIGS. 6 & 7, the valve sub-bases 100 can be coupled into rows prior to being coupled into columns.

The valve island 900 can therefore be adjusted using the first, second, third, and fourth coupling members 106*a*-106*d*. Therefore, the orientation of the valves 112 can be adjusted depending on the particular fluid connections present or required by the user. As a result, multiple manifolds do not need to be manufactured based on various user configurations. Further, the customer is not required to custom order a specific manifold to meet the user's required fluid connections. Rather, the orientation and the configuration of the various valve sub-bases 100 can be changed and adjusted based on the desired fluid connections. Further, if certain fluid connections require smaller or larger nozzles, 102, a valve 112 may be coupled to an appropriate valve sub-base 100 with the remaining valve sub-bases 100 having different sized nozzles 102.

The detailed descriptions of the above embodiments are not exhaustive descriptions of all embodiments contemplated by the inventors to be within the scope of the invention. Indeed, persons skilled in the art will recognize that certain elements of the above-described embodiments may variously be combined or eliminated to create further embodiments, and such further embodiments fall within the scope and teachings of the invention. It will also be apparent to those of ordinary skill in the art that the above-described embodiments may be combined in whole or in part to create additional embodiments within the scope and teachings of the invention.

Thus, although specific embodiments of, and examples for, the invention are described herein for illustrative purposes, various equivalent modifications are possible within the scope of the invention, as those skilled in the relevant art will recognize. The teachings provided herein can be applied to other valve systems, and not just to the embodiments described above and shown in the accompanying figures. Accordingly, the scope of the invention should be determined from the following claims.

We claim:

1. A valve sub-base (100) including a coupling system (200), comprising:
- a female coupling member (106 *a*) formed on a protrusion on a first side (151) of the valve sub-base (100); and
- a male coupling member (106 *b*) disposed substantially orthogonally to the first face of the valve sub-base, and formed on a second side (152) of the valve sub-base (100) and configured to engage a corresponding female coupling member (106 *a*) on an adjoining valve sub-base (100) to couple two or more valve sub-bases (100) by placing the valve sub-base adjacent to the adjoining valve sub-base and rotating at least one of the valve sub-base and adjoining valve sub-base.

2. The valve sub-base (100) of claim 1, further comprising:
- a second female coupling member (106 *c*) formed on a third side (153) of the valve sub-base (100); and
- a second male coupling member (106 *d*) formed on a fourth side (154) of the valve sub-base (100) and configured to engage a corresponding second female coupling member (106 *c*) formed on an adjoining valve sub-base (100).

3. The valve sub-base (100) of claim 1, further comprising:
- a male coupling member (106 *b*) formed on the first side (151) of the valve sub-base (100); and
- a female coupling member (106 *a*) formed on the second side (152) of the valve sub-base (100) and configured to engage a corresponding male coupling member (106 *b*) formed on an adjoining valve sub-base (100).

4. A valve system (20), comprising:
- a valve (112) including one or more fluid ports (101 *a*-101 *c*);
- a valve sub-base (100) coupled to the valve (112) and forming a fluid-tight seal with the one or more fluid ports (101 *a*-101 *c*), the valve sub-base (100) including:
  - one or more nozzles (102 *a*-102 *c*) in fluid communication with the one or more fluid ports (101 *a*-101 *c*);
- a coupling system (200) comprising:
  - a female coupling member (106 *a*) formed on a protrusion on a first side (151) of the valve sub-base (100); and
  - a male coupling member (106 *b*) disposed substantially orthogonally to the first face of the valve sub-base, and formed on a second side (152) of the valve sub-base (100) and configured to engage a corresponding female coupling member (106 *a*) formed on an adjoining valve sub-base (100) by placing the valve sub-base adjacent to the adjoining valve sub-base and rotating at least one of the valve sub-base and adjoining valve sub-base.

5. The valve system (20) of claim 4, further comprising:
- a second female coupling member (106 *c*) formed on a third side (153) of the valve sub-base (100); and a second male coupling member (106 *d*) formed on a fourth side (154) of the valve sub-base (100) and configured to engage a corresponding second female coupling member (106 *c*) formed on an adjoining valve sub-base (100).

6. The valve system (20) of claim 4, further comprising:

a male coupling member (106 *b*) formed on the first side (151) of the valve sub-base (100); and a female coupling member (106 *a*) formed on the second side (152) of the valve sub-base (100) and configured to engage a corresponding male coupling member (106 *b*) formed on an adjoining valve sub-base (100).

7. The valve system (20) of claim 4, further comprising a fastener receiver (105) formed in the valve sub-base (100) and configured to receive a fastener (104) to retain the valve sub-base (100) coupled to the valve (112).

8. A valve island (900), comprising:

a first valve (112);

a first valve sub-base (100) coupled to the first valve (112) and including:

a female coupling member (106 *a*) formed on a protrusion on a first side (151) of the first valve sub-base (100);

a male coupling member (106 *b*) disposed substantially orthogonally to the first face of the first valve sub-base, and formed on a second side (152) of the first valve sub-base (100);

a second valve (112') positioned proximate the first valve (112);

a second valve sub-base (100') coupled to the second valve (112') and including:

a female coupling member (106 *a'*) formed on a protrusion on a first side (151') of the second valve sub-base (100');

a male coupling member (106 *b'*) disposed substantially orthogonally to the first face of the valve sub-base, and formed on a second side (152') of the second valve sub-base (100') and configured to engage the female coupling member (106 *a*) formed on the first side (151) of the first valve sub-base (100) by placing the first valve sub-base adjacent to the second valve sub-base and rotating at least one of the first valve sub-base and second valve sub-base.

9. The valve island (900) of claim 8, further comprising:

a female coupling member (106 *c*) formed on a third side (153) of the first valve sub-base (100); and a male coupling member (106 *d*) formed on a fourth side (154) of the first valve sub-base (100);

a third valve (112") positioned proximate the first valve (112);

a third valve sub-base (100") coupled to the third valve (112") and including:

a female coupling member (106 *a"*) formed on a third side (153") of the third valve sub-base (100"); and a male coupling member (106 *b"*) formed on a fourth side (154") of the third valve sub-base (100") and configured to engage the female coupling member (106 *c*) formed on the third side (153) of the first valve sub-base (100).

10. The valve island (900) of claim 8, further comprising:

a male coupling member (106 *b*) formed on the first side (151) of the first valve sub-base (100);

a female coupling member (106 *a*) formed on the second side (152) of the first valve sub-base (100);

a male coupling member (106 *b*) formed on the first side (151) of the second valve sub-base (100); and a female coupling member (106 *a*) formed on the second side (152') of the second valve sub-base (100) and configured to engage the male coupling member (106 *b*) formed on the first side (151) of the first valve sub-base (100).

* * * * *